US009963948B2

(12) United States Patent
Tao et al.

(10) Patent No.: US 9,963,948 B2
(45) Date of Patent: May 8, 2018

(54) ON-DEMAND RELEASE TOOL SYSTEM AND METHODOLOGY

(71) Applicant: Schlumberger Technology Corporation, Sugar Land, TX (US)

(72) Inventors: Jia Tao, Sugar Land, TX (US); Keith Eugene Barnard, Missouri City, TX (US); Christopher Sarvari, Missouri City, TX (US); Mohamed Mehdi, Houston, TX (US); Corey Lehman, Needville, TX (US); David Iblings, Rosharon, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 438 days.

(21) Appl. No.: 14/660,351

(22) Filed: Mar. 17, 2015

(65) Prior Publication Data

US 2015/0259996 A1 Sep. 17, 2015

Related U.S. Application Data

(60) Provisional application No. 61/954,210, filed on Mar. 17, 2014.

(51) Int. Cl.

| | |
|---|---|
| ***E21B 23/00*** | (2006.01) |
| ***E21B 17/06*** | (2006.01) |
| *E21B 43/116* | (2006.01) |

(52) U.S. Cl.

CPC ..... *E21B 23/00* (2013.01); *E21B 17/06* (2013.01); *E21B 43/116* (2013.01)

(58) Field of Classification Search

CPC ..... E21B 23/00; E21B 17/06; E21B 43/116

See application file for complete search history.

(56) References Cited

U.S. PATENT DOCUMENTS

| | | | | |
|---|---|---|---|---|
| 5,184,676 A * | 2/1993 | Graham | E21B 4/18 | 166/104 |
| 5,293,940 A * | 3/1994 | Hromas | E21B 23/04 | 166/297 |
| 6,003,599 A * | 12/1999 | Huber | E21B 43/119 | 166/255.2 |
| 6,817,598 B2 * | 11/2004 | Parrott | E21B 40/00 | 166/382 |
| 2002/0053434 A1 * | 5/2002 | Chen | E21B 23/01 | 166/297 |
| 2002/0100360 A1 * | 8/2002 | Rochen | E21B 43/116 | 891/1.15 |

(Continued)

*Primary Examiner* — Shane Bomar

(57) ABSTRACT

A technique facilitates on-demand release of desired sections of a well string, e.g. sections of a perforating gun string, via at least one on-demand release tool. The on-demand release tool has an activation mechanism which may be selectively actuated to transition the on-demand release tool from a first loadbearing configuration to a second loadbearing configuration. The on-demand release tool may then be transitioned to a release stage which allows a first section of the on-demand release tool to be separated from a second section of the on-demand release tool by activating a release mechanism. In at least some applications, the on-demand release tool also comprises a ballistic transfer device to enable reliable ballistic transfer between sections of the perforating gun string.

19 Claims, 8 Drawing Sheets

(56) References Cited

U.S. PATENT DOCUMENTS

2004/0200655 A1* 10/2004 Mueller ..... B60K 17/16
180/248
2017/0175499 A1* 6/2017 Prisbell ..... E21B 43/116

* cited by examiner

ON-DEMAND RELEASE TOOL SYSTEM AND METHODOLOGY

CROSS-REFERENCE TO RELATED APPLICATIONS

The present document is based on and claims priority to U.S. Provisional Application Ser. No. 61/954,210, filed Mar. 17, 2014, which is incorporated herein by reference in its entirety.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled and cased, a perforating gun string may be conveyed downhole and used to create perforations which extend through the casing and out into the surrounding formation. However, sections of the perforating gun string may become stuck in the wellbore following the perforating operation. Certain tools exist to release the perforating gun string from the remainder of the tool string for later retrieval of the perforating gun string. However, existing tools are limited in their ability to provide on-demand functionality and in their ability to release specific sections of the perforating gun string.

SUMMARY

In general, a methodology and system are provided which facilitate on-demand release of desired sections of a well string, e.g. sections of a perforating gun string, via at least one on-demand release tool. The on-demand release tool has an activation mechanism which may be selectively actuated to transition the on-demand release tool from a first load-bearing configuration to a second loadbearing configuration. The on-demand release tool may then be transitioned to a release stage which allows a first section of the on-demand release tool to be separated from a second section of the on-demand release tool by activating a release mechanism. In at least some applications, the on-demand release tool also comprises a ballistic transfer device to enable reliable ballistic transfer between sections of the perforating gun string.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
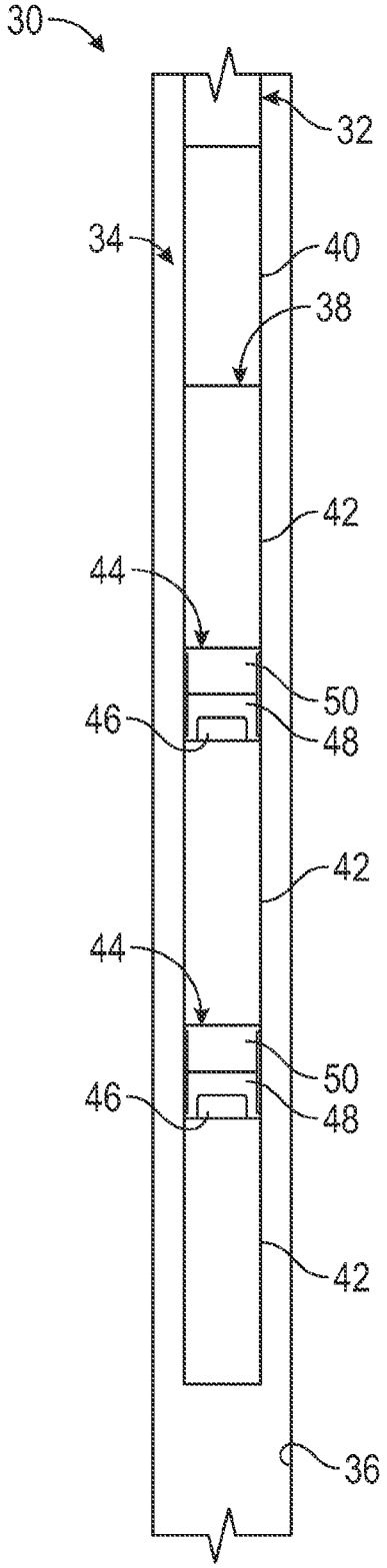
FIG. 1 is a schematic illustration of a well system comprising a well string having a gun string with a plurality of gun string assemblies or sections coupled by on-demand release tools, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a methodology and system which facilitate on-demand release of desired sections of a well string via at least one on-demand release tool. For example, a gun string may have a plurality of gun string sections coupled sequentially by a plurality of the on-demand release tools. The on-demand release tools may be selectively actuated to release a portion of the string above the actuated tool for removal from the borehole. According to embodiments, each on-demand release tool has an activation mechanism which may be selectively actuated to transition the on-demand release tool from a first loadbearing configuration to a second loadbearing configuration. The on-demand release tool may then be transitioned to a release stage which allows a first section of the on-demand release tool to be separated from a second section of the on-demand release tool by activating a release mechanism.

According to an embodiment, a device is provided for selectively disconnecting sub sections of a perforating gun string. The device is in the form of an on-demand release tool which may be utilized if, for example, sections of the perforating gun string become stuck/sanded-in before or after perforating. For example, if a well as a gross perforating interval of a given length, e.g. 2000 ft, that is to be perforated in a single perforating trip, a plurality of on-demand release tools may be disposed along the gun string at select intervals between gun string section/assemblies, e.g. at intervals of 250-300 ft. However, the number of on-demand release tools, spacing between the tools, and overall lengths of the gross perforating interval may vary substantially between different applications. The use of on-demand release tools at desired spacings along the gun string enable retrieval of the maximum footage of guns above the stuck point to improve the success rate of wash over/fishing operations. Thus, the risk of losing the well is reduced. Additionally, cost savings may be realized by implementing such contingency on-demand release devices with the perforating gun string, especially for deep water, high-expense wells.

In an example of an on-demand release tool, the system architecture of the tool utilizes a ballistic transfer mechanism/system for inter-gun application. By way of example, the tool may be in the form of a rigid section during initial deployment to ensure accurate depth control and reliable ballistic transfer. The structure of the tool enables deployment and retrieval of a full gun string in normal operation. In case of a stuck gun string, either before or after perforating, the tool structure enables an on-demand disconnect of a section of the gun string via, for example, disconnection at the nearest device above the stuck point. Following disconnection, the remaining length of gun string is left downhole for a later fishing/washout procedure. Depending on the embodiment, disconnection at a given on-demand release tool may comprise multiple actuation inputs in sequence so as to avoid accidental release. The actuation may include one or more events alone or in combination. Examples of such events comprise applying torque or rotation; applying tension or overpull; applying annulus or tubing pressure; applying compression or weight; applying reciprocating movement of the gun string; employing a ballistic event; and/or other events or combinations of events.

Referring generally to FIG. 1, an embodiment of a well system 30 is illustrated as comprising a well string 32 deployed in a borehole 34, e.g. wellbore. In some applications, the borehole 34 may be cased with a well casing 36. In the example illustrated, the well string 32 comprises a gun string 38 which may be combined with other equipment 40, such as a bottom hole assembly.

In the example illustrated, the gun string 38 comprises a plurality of gun string sections 42, e.g. assemblies, and at least some of the gun string sections 42 (and/or other sections of well string 32) may be joined by devices in the form of on-demand release tools 44. In FIG. 1, a pair of release tools 44 is illustrated, but the gun string 38 may comprise other numbers of tools 44, including a single tool or multiple tools distributed along the gun string 38 according to the parameters of a given application. By way of example, each on-demand release tool 44 may comprise a ballistic transfer mechanism 46, an activation mechanism 48, and a release mechanism 50.

The ballistic transfer mechanism 46 of each tool 44 enables intergun applications via passage of a ballistic chain from, for example, an upper gun string section 42 to the next sequentially lower gun string section 42 on a opposite side of the tool 44 connected in-between. An example of a suitable ballistic transfer mechanism 46 is the sealed ballistic transfer (SBT) system which is an existing technology available from Schlumberger® and widely used in Schlumberger® TCP tools. The SBT system transfers detonation by initiating a trigger charge (housed inside an upper portion of the tool 44), which then detonates a receptor booster (housed inside a lower portion of the tool 44), and subsequently detonates a detonating cord connected thereto. With this arrangement, the ballistic chain is free to separate and thus allows the device to disconnect even before gun firing. However, a variety of other types of ballistic transfer mechanisms 46 may be employed to enable ballistic transfer while allowing disconnection of the tool 44.

The activation mechanism 48 of each on-demand release tool 44 may be employed during an activation stage to transform the tool 44 from its initial deployment status to ready-to-disconnect status. In the ready-to-disconnect configuration, the tool 44 is still connected but no longer a rigid piece such that a subsequent releasing actuation can be exercised to eventually disconnect the tool 44. Once the tool 44 is disconnected, portions of the tool 44 may be separated to enable removal of an upper section of the gun string 38 while a lower section of the gun string 38 below that particular tool 44 remains in the borehole 34, at least until later retrieval.

Figure 2:
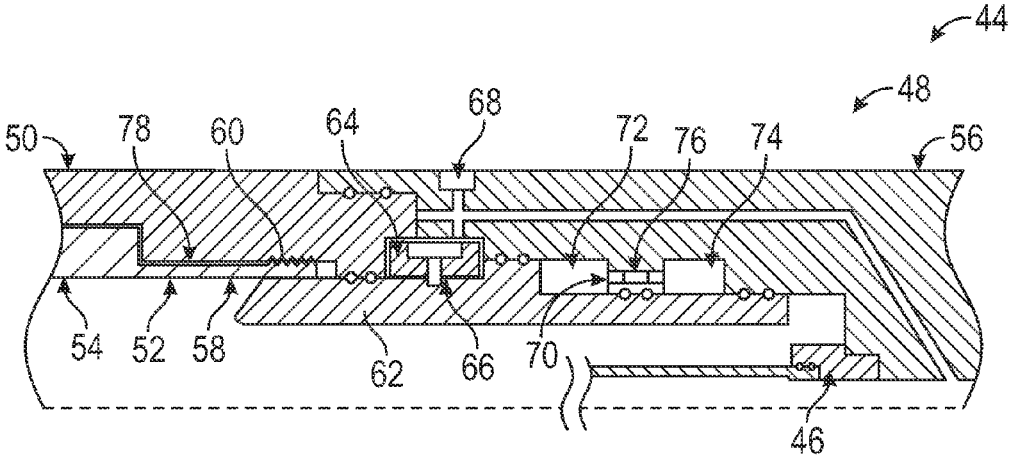
FIG. 2 is a cross-sectional view of a portion of an embodiment of an on-demand release tool comprising an example of an activation mechanism and a ballistic transfer mechanism, according to an embodiment of the disclosure.

Referring generally to FIG. 2, an embodiment of the activation mechanism 48 is illustrated although portions of ballistic transfer mechanism 46 and release mechanism 50 also are illustrated. In this example, the activation mechanism 48 employs a release mandrel 52 which extends from the corresponding release mechanism 50 into cooperation with activation mechanism 48 and rigidly connects a first section 54 of tool 44 with a second section 56 of tool 44. By way of example, the first section 54 may be an upper section and the second section 56 may be a lower section along the borehole 34. In borehole applications, the upper section refers to the section positioned uphole relative to the lower section regardless of the orientation of the borehole 34.

The rigid connection resists or ensures against relative movement between the first section 54 and the second section 56 during initial deployment. The release mandrel 52 may have a collapsible collet feature 58 which is coupled with the second section 56 via, for example, a threaded connection 60. The threaded connection 60 is secured in place during initial deployment by a support piston 62, and the support piston 62 is kept in position by a retaining ring 64 and a shear member 66, e.g. a shear pin or shear pins. The collet 58 initially holds the first section 54 and the second section 56 in a first loadbearing configuration.

To actuate the activation mechanism 48 before gun firing, annulus pressure may be increased to open a flow passage, e.g. to break a rupture disc 68, so that annulus pressure may act against support piston 62. The support piston 62 then starts shifting slowly as controlled via a hydraulic delay mechanism 70 in which a liquid, e.g. silicon oil, is displaced from a liquid chamber 72 to a gas, e.g. air, chamber 74 through an orifice 76. Once the support piston 62 is fully shifted, the collapsible collet 58 becomes unsupported and the first loadbearing connection between the first section 54 and the second section 56 of the device/tool 44 is free to release under some tension. Thereafter, the tool 44 is held together and disconnection is resisted by a second load bearing connection in release mechanism 50, as discussed in greater detail below. Once the activation mechanism 48 has been thus actuated, the tool 44 may be shifted to a second loadbearing configuration and is placed at a status ready for release actuation. The release actuation enables disconnection of the first section 54 from the second section 56.

For activation of mechanism 48 after gun firing, the tool 44 may feature an explosives initiated automatic activation mechanism 48 which utilizes the detonation pressure during perforation and/or well pressure after perforation to shift the support piston 62. Regardless of the activation technique, the hydraulic delay mechanism 70 may be used to delay shifting of the support piston 62, thus slightly delaying activation of the tool 44. This delay can be helpful because tool activation, i.e. switching to the second load bearing configuration, may involve movement of tool 44. However, such device/tool movement may not be desirable during the course of a perforation operation because it can shift the perforating depth of lower perforating gun sections 42 and/or amplify the detonation shock to the gun string 38.

A contingency technique may be provided in case the support piston 62 is not able to shift in certain scenarios. One example of such a scenario is a failed ballistic transfer after partial firing of the gun string 38, thus providing insufficient build-up of annulus pressure in the presence of open perforations. The inability to build-up sufficient annulus pressure reduces the chance of activating the desired tool or tools 44 in the unperforated section. The contingency technique utilizes a weak point 78 integrated into the collapsible collet 58. The weak point 78 may be constructed as the weakest link of the entire gun string 38 and allows the collapsible collect 58 to be pulled apart while still enabling activation of the tool 44 for a subsequent releasing maneuver.

Figure 3:
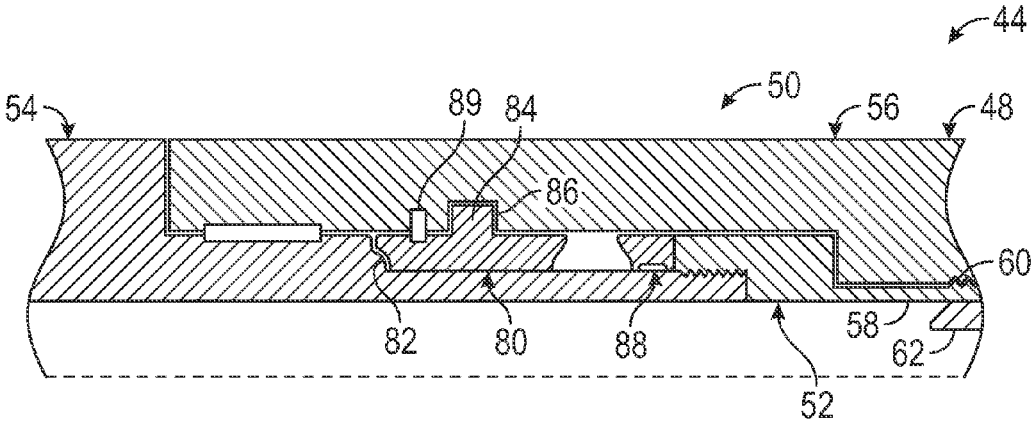
FIG. 3 is a cross-sectional view of a portion of an embodiment of an on-demand release tool comprising an example of a release mechanism, according to an embodiment of the disclosure.
Figure 4:
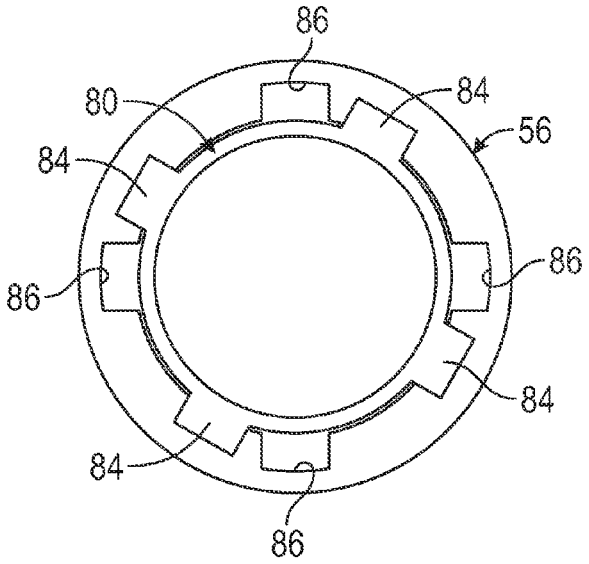
FIG. 4 is a cross-sectional view taken generally perpendicular to an axis of the release mechanism through an index ring of the release mechanism, according to an embodiment of the disclosure.
Figure 5:
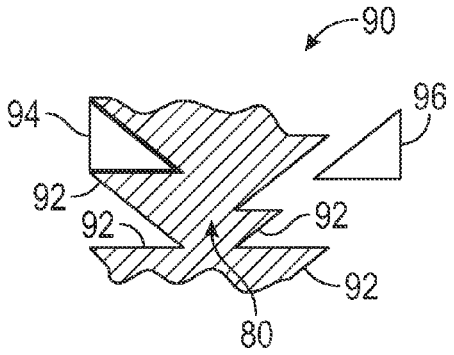
FIG. 5 is a schematic illustration of a portion of an embodiment of an index ring, according to an embodiment of the disclosure.
Figure 6:
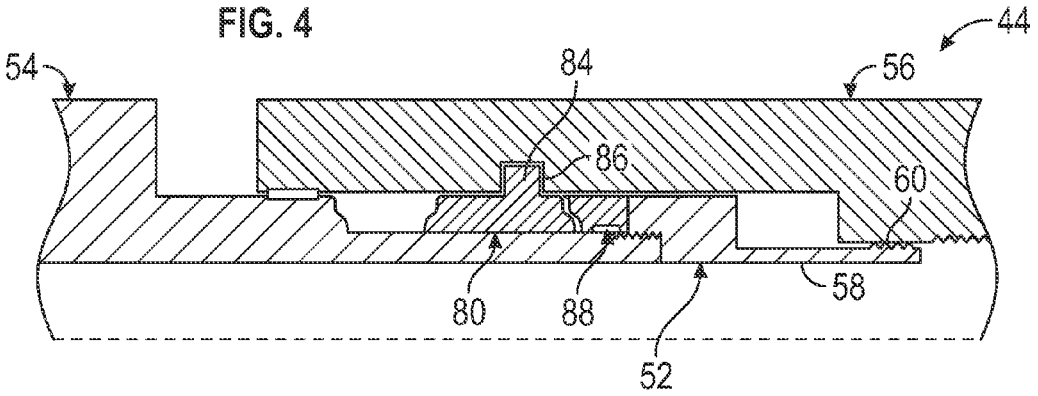
FIG. 6 is a cross-sectional view of the release mechanism similar to that illustrated in FIG. 3 but in a different operational position, according to an embodiment of the disclosure.

Referring generally to FIGS. 3-5, an example of the release mechanism 50 is illustrated. The release mechanism 50 is constructed to enable disconnection of the tool 44, e.g. disconnection of the first section 54 from the second section 56 via single or multiple cycles of a pull-push-pull action. After the activation mechanism 48 is actuated to release the first load bearing connection, the first section 54 and second section 56 of the tool 44 start to move away from each other when under tension until they are held by the second load bearing connection, as illustrated in FIG. 6.

In the illustrated embodiment, release mechanism 50 also forms a connection between the first section 54 and the second section 56 via an index ring 80. The index ring 80 shoulders against the first section 54 at a shoulder 82 and latches to the second section 56 via locking arms 84 and a corresponding groove 86, e.g. an L-shape groove, formed into the inside diameter of a housing of the lower section 56. The locking arms 84 are at a first position (see FIG. 4) during initial deployment and turn to a second position (see FIG. 7) when the second load bearing connection is fully engaged via engagement of index ring 80 with a corresponding ratchet ring 88. As explained in greater detail below, some embodiments also may utilize a shear member 89, e.g. shear screws 89, to provide a predetermined initial resistance to shifting of the index ring 80.

Figure 7:
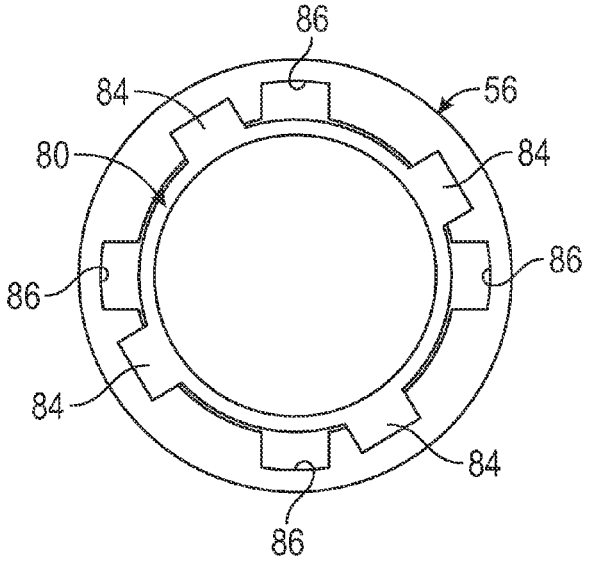
FIG. 7 is a cross-sectional view similar to that of FIG. 4 but in a different operational position, according to an embodiment of the disclosure.

The rotation from the first position illustrated in FIG. 4 to the second position illustrated in FIG. 7 may be accomplished by using a ratchet mechanism 90 which employs a plurality of ratchet teeth 92 on index ring 80. The ratchet teeth 92 have mismatched phasing with respect to a corresponding ratchet tooth or teeth 94 positioned on first section 54 in the region of shoulder 82. The ratchet teeth 92 of ratchet mechanism 90 also have a mismatched phasing with respect to a corresponding tooth or teeth 96 located on ratchet ring 88. FIG. 5 illustrates an example of the positioning of respective teeth 92, 94 and 96 when the release mechanism 50 is in the operational position illustrated in FIG. 3.

Figure 8:
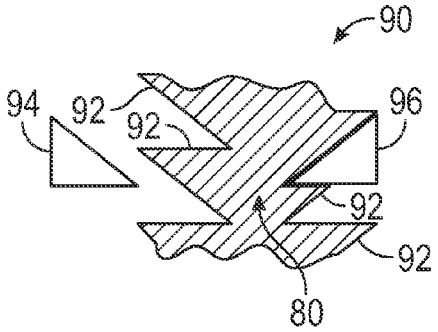
FIG. 8 is a schematic illustration similar to that of FIG. 5 but in a different operational position, according to an embodiment of the disclosure.

The rotation of locking arms 84 from the first position to the second position may be achieved by utilizing the ratchet mechanism 90. For example, as the index ring 80 is moved into the second load bearing configuration illustrated in FIG. 6, the ratchet teeth 92 on the index ring 80 engage, at a mismatched phasing, with the teeth 96 on the ratchet ring 88 (see FIG. 8). The tapered contact interface between the two sets of teeth 92, 96 interacts and aligns the phasing of the index ring 80 and ratchet ring 88. In this example, the ratchet ring 88 may be splined so that the ratchet ring 88 does not rotate and thus forces the index ring 80 to rotate to the second position (see FIG. 7), as defined by the geometry/dimension of the ratchet teeth 92, 96. This movement from the first position to the second position results from a first pull action and, at this stage, the gun string 38 still can be retrieved in full as long as the gun string 38 is not stuck.

Figure 9:
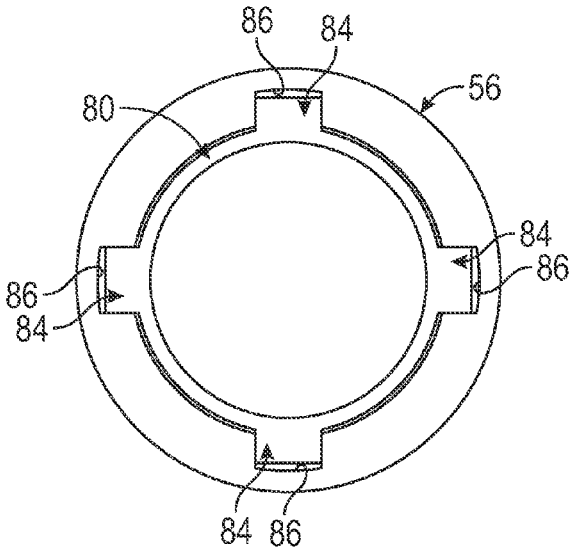
FIG. 9 is a cross-sectional view similar to that of FIG. 4 but in a different operational position, according to an embodiment of the disclosure.
Figure 10:
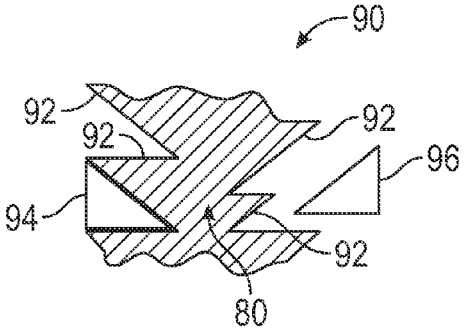
FIG. 10 is a schematic illustration similar to that of FIG. 5 but in a different operational position, according to an embodiment of the disclosure.

In case the string 38 is stuck and separation is desired, compression is applied to the tool 44 before pulling it apart. When being compressed, the first section 54 and the second section 56 of the on-demand release tool 44 move, e.g. are pushed, towards each other. As the compression movement continues, the ratchet teeth 94 on the first section 54, e.g. on a mandrel portion of section 54, engage the corresponding teeth 92 of index ring 80. As the ratchet teeth 94 move into full engagement with the corresponding teeth 92, the locking arms 84 of the index ring 80 are rotated to a third position which is a release stage, as illustrated in FIGS. 9 and 10. In this third position, the locking arms 84 are aligned with portions of corresponding grooves 86 which allow release and separation of first section 54 from second section 56.

Figure 11:
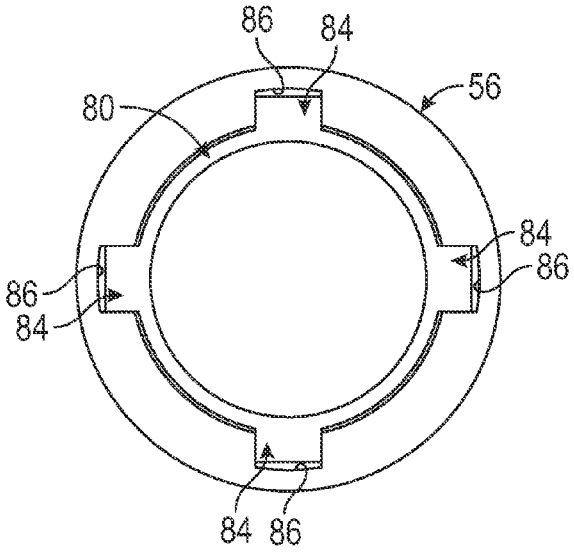
FIG. 11 is a cross-sectional view similar to that of FIG. 4 but in a different operational position, according to an embodiment of the disclosure.
Figure 12:
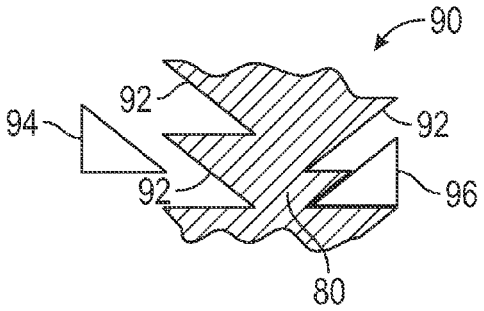
FIG. 12 is a schematic illustration similar to that of FIG. 5 but in a different operational position, according to an embodiment of the disclosure.

This movement from the second position (see FIGS. 7 and 8) to the third position (see FIGS. 9 and 10) results from a push action. By applying another pull action, the ratchet teeth 96 of ratchet ring 88 again engage ratchet teeth 92 of index ring 80, as illustrated in FIGS. 11 and 12. In this position, continued pulling on well string 32 enables first section 54 of tool 44 to be slid away from the corresponding second section 56. It should be noted that, at the third position, the ratchet teeth 92 on index ring 80 and the ratchet teeth 96 on ratchet ring 88 are in-phase with each other and that no further rotation of index ring 80 is intended as teeth 96 engage corresponding teeth 92 (see FIG. 12). Thus, at this stage, the first section 54 can simply be pulled straight out relative to second section 56 and the on-demand release tool 44 is separated to enable removal of the portion of gun string 38 located uphole from that particular tool 44.

The amount of rotation of index ring 80 per each push/pull action may be determined by the geometry and/or profile of the ratchet teeth 92, 94, 96. Therefore, the rotation angle per each pull-push-pull cycle can be reduced to include more cycles for disconnection of the device. In addition, the width of the locking arms 84 also can be adjusted to enable use of a greater number of pull-push-pull cycles before disconnection of tool 44. Having the capability to select single or multiple-cycle(s)-to-disconnect tool 44 enables the functionality of selective release from the nearest device above the stuck point. In other words, different numbers of pull-push-pull cycles may correspond with different tools 44 to enable separation at a specifically selected tool 44.

In some embodiments, to help ensure the gun string 38 separates at the nearest tool 44 above the stuck point, a passive disconnect selection algorithm can be implemented. For example, a mechanism may be used to initially resist compression of the tool 44 during the push action. An example of such a mechanism is the shear member 89, e.g. shear screws, which may be located between the second section 56 and index ring 80 (see, for example, FIG. 3). The shear screws 89 (or other shear mechanism) resist shifting of the index ring 80 to the third position illustrated in FIG. 9 which would enable disconnection and separation of tool 44. Different numbers or specifications of shear screws or other shear members can be used to achieve different shear values, i.e. different compression loads to complete the compression/push action. In at least some embodiments, the compression load for shearing the shear member 89 of each sequential tool 44 decreases with a depth increase of their position in the gun string 38. In this arrangement, it is the tool 44 lower in the gun string 38 that tends to complete the push action earlier. By so selecting a unique, predetermined compression load for actuating individual tools 44, the first tool 44 to release should be the nearest tool 44 above the stuck point.

In some embodiments, construction variations can be used to enable release with single or multiple pull-push-pull cycles. By assigning the bottom-most tool 44 with the least number of cycles-to-release and increasing the number of cycles-to-release for tools 44 positioned at decreasing depth, the first on-demand release tool 44 to release is the nearest tool 44 above the stuck point. In other words, an algorithm may be utilized to differentiate at least one of, for example, a predetermined shear load and a predetermined number of cycles employed for separation of a specific on-demand release tool 44 among a plurality of individual on-demand release tools 44 deployed in the gun string 38.

Referring generally to FIGS. 13-17, another embodiment of on-demand release tool 44 is illustrated. In this embodiment, the ballistic transfer device 46 and the activation mechanism 48 may be similar to embodiments described above, however the release mechanism 50 has a different construction and may utilize another type of disconnect selection algorithm. However, a series of pull-push-pull actions on well string 32 may again be used to provide a controlled disconnection at a desired tool 44.

Figure 13:
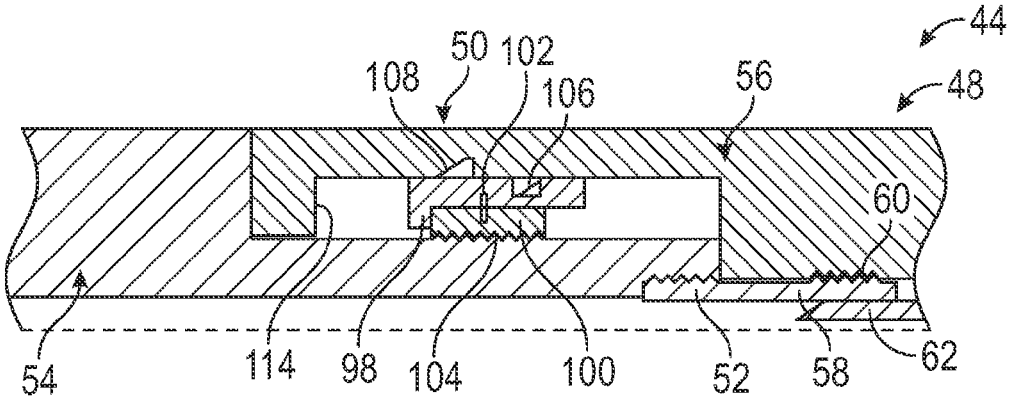
FIG. 13 is a cross-sectional view of another example of a release mechanism, according to an embodiment of the disclosure.

As illustrated in FIG. 13, the activation mechanism 48 may again operate in conjunction with release mandrel 52 and collapsible collet 58. In this embodiment, the release mechanism 50 comprises a retainer ring 98, e.g. retainer sleeve, and a split ring 100 located radially between portions of first section 54 and the second section 56. Initially, the retainer ring 98 is secured against longitudinal movement with respect to the split ring 100 by a shear member 102, such as a shear pin or shear pins. Additionally, the split ring 100 may be secured to a radially inward portion of upper section 54 via a suitable fastening mechanism 104, such as a threaded engagement region between the split ring 100 and the adjacent portion of first section 54.

Figure 14:
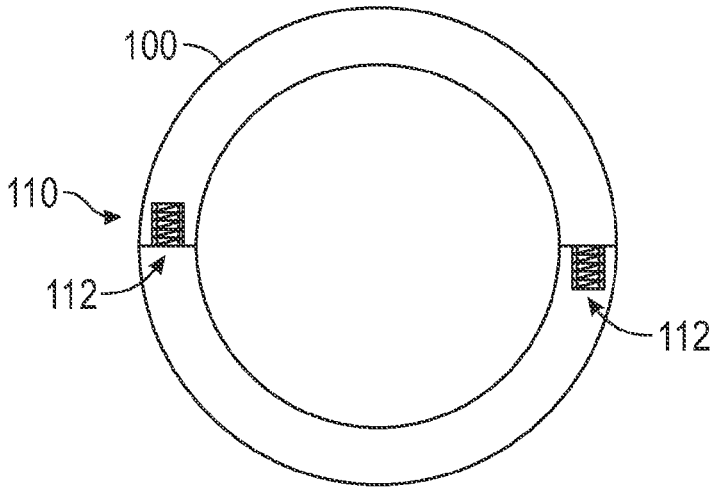
FIG. 14 is a cross-sectional view taken generally perpendicular to an axis of the release mechanism through a split ring of the release mechanism illustrated in FIG. 13, according to an embodiment of the disclosure.

As further illustrated, the retainer ring 98 may comprise at least one pop-up dog 106, such as a spring-loaded dog. In the initial position illustrated in FIG. 13, the pop-up dog 106 is in a radially retracted position separated from a corresponding dog recess (or recesses) 108 formed along an inside diameter of the corresponding portion of second section 56. In this example, the split ring 100 also is initially held in a radially retracted configuration, as illustrated in FIG. 14. However, a biasing member 110 provides a force which biases the split ring 100 to an expanded configuration. By way of example, the biasing member 110 may comprise a plurality of springs 112 which are compressed when the split ring 100 is in the radially retracted configuration. Once the perforation operation is performed, the activation mechanism 48 of each tool 44 is actuated to release collapsible collet 58 and to place each tool 44 into a ready-to-disconnect status.

Figure 15:
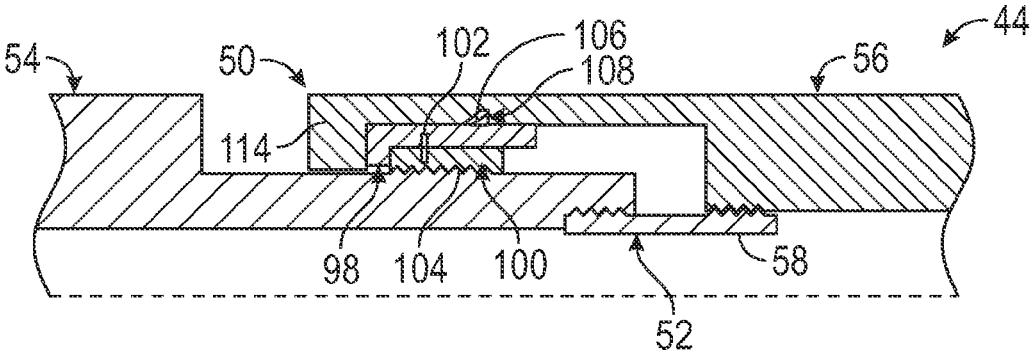
FIG. 15 is a cross-sectional illustration similar to that of FIG. 13 but in a different operational position, according to an embodiment of the disclosure.

In the ready-to-disconnect status, the tool 44 has been transitioned to the second loadbearing configuration, as illustrated in FIG. 15, via a first pull action. During the first pull action, the first section 54 is moved away from the second section 56 until the second loadbearing connection is achieved as a shoulder 114 of second section 56 engages retaining ring 98. The retaining ring 98 is held in position by its abutting engagement with split ring 100 which is secured, e.g. threadably secured, to first section 54 via fastening member 104. As illustrated, the split ring 100 is constrained inside of the retaining ring 98 and the fastening member/threaded connection 104 secures the split ring 100 to the corresponding portion of first section 54. Additionally, the pull action shifts the retainer ring 98 along second section 56 until the pop-up dog (or dogs) 106 can be moved outwardly to engage the corresponding dog recess (or recesses) 108, as also illustrated in FIG. 15. In this configuration, the tool 44 is able to bear tensile loading so as to allow withdrawal of the entire gun string 38.

Figure 16:
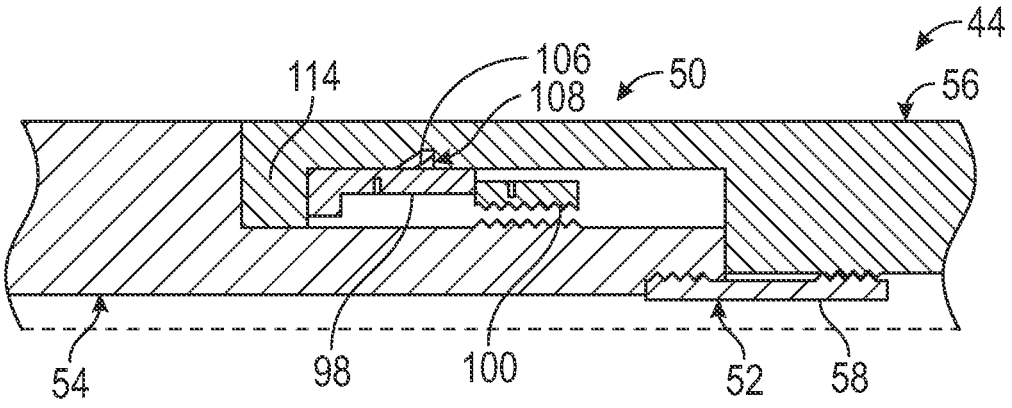
FIG. 16 is a cross-sectional illustration similar to that of FIG. 13 but in a different operational position, according to an embodiment of the disclosure.
Figure 17:
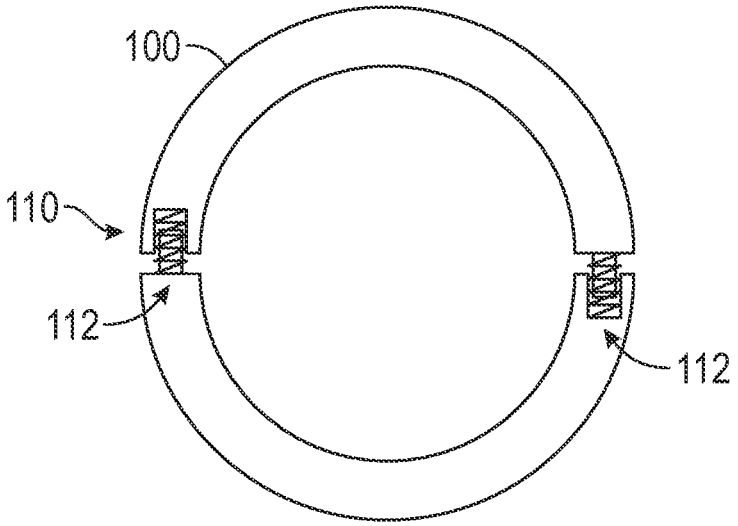
FIG. 17 is a cross-sectional view similar to that of FIG. 14 but in a different operational position, according to an embodiment of the disclosure.

If, however, the gun string 38 become stuck a push action can be used to initiate a separation or disconnection of the tool 44. During the push action, the first section 54 moves toward the second section 56 while the retainer ring 98 is held in position by the pop-up dog(s) 106 which remain latched into the corresponding dog recess(es) 108. While the retainer ring 98 is held in position, the split ring 100 moves with the upper section 54 until the split ring 100 slides from under the retainer ring 98. Once the split ring 100 slides out of the retainer ring 98, the biasing member 110, e.g. springs 112, expands the split ring 100 and thus disengages the connection between the split ring 100 and the upper section 54 (e.g. disengages fastening member 104), as illustrated in FIGS. 16 and 17. At this release stage, the first section 54 and the second section 56 are disconnected and a pull action causes separation of sections 54, 56 at the tool 44. The portion of gun string 38 above that specific tool 44 can then be retrieved to the surface.

As with the embodiments described above, different numbers or specifications of shear members 102, e.g. shear screws, can be used to achieve different shear values, i.e. different compression loads to complete the compression/push action. In at least some embodiments, the compression load for shearing the shear member(s) 102 of each sequential tool 44 decreases as the depth of their position in the gun string 38 increases. In this arrangement, it is the tool 44 lower in the gun string 38 that tends to complete the push action earlier. By controlling the increase of compression/push load, the first tool 44 to release should be the nearest tool 44 above the stuck point.

Figure 18:
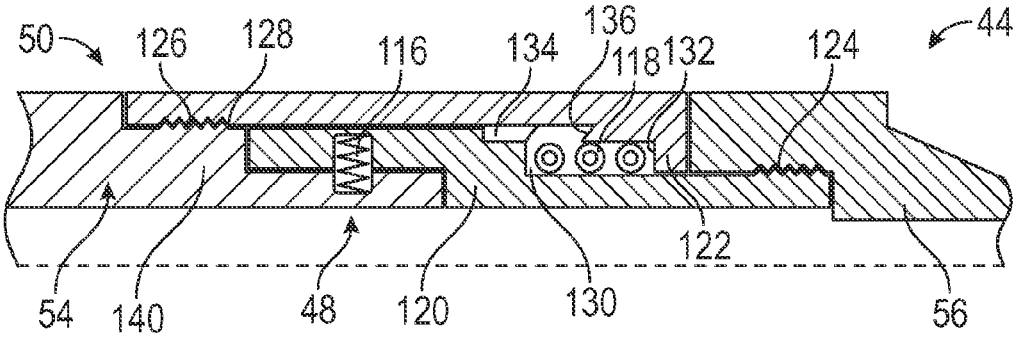
FIG. 18 is a cross-sectional illustration of another example of an activation mechanism and release mechanism, according to an embodiment of the disclosure.
Figure 19:
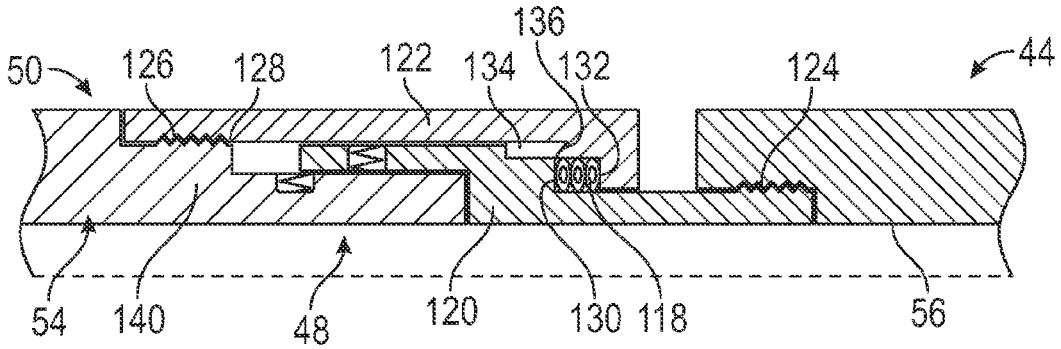
FIG. 19 is a cross-sectional view similar to that of FIG. 18 but in a different operational position, according to an embodiment of the disclosure.

Referring generally to FIGS. 18 and 19, another embodiment of on-demand release tool 44 is illustrated. In this embodiment, the ballistic transfer device 46 may be similar to embodiments described above, however activation mechanism 48 and the release mechanism 50 have different constructions.

In this embodiment, a first loadbearing connection comprises a shear member 116, such as a plurality of shear screws. The shear member 116 initially connects the first section 54 and the second section 56 of the on-demand release tool 44 in a first loadbearing configuration, as illustrated in FIG. 18. For activation of tool 44, an over pull force is applied to break the shear member 116. The first section 54 and the second section 56 of tool 44 then move away from each other under tensile load. A crushable element 118 is positioned between the sections 54, 56 to cushion any rapid movement and to reduce the impact load that may result from the over pull force. In a specific example, the crushable element 118 is positioned between a spline sleeve 120 and a spline housing 122. In this latter embodiment, the spline sleeve 120 is connected to a remainder of the second section 56 via a fastening mechanism 124, such as a threaded engagement region. Similarly, the spline housing 122 is connected to the first section 54 via a fastening mechanism 126, such as a threaded engagement region. As described in greater detail below, the fastening mechanism 126 may comprise a left-hand thread 128.

After actuation of activation mechanism 48, the tool 44 is held at the second of loadbearing configuration by a shoulder 130 of the spline sleeve 120 and a shoulder 132 of the spline housing 122 with compressed crushable element 118 located therebetween, as illustrated in FIG. 19. As the spline sleeve 120 approaches the spline housing 122 to crush the crushable element 118, a spline finger or fingers 134 engage with a corresponding spline grooves or grooves 136 of spline housing 122. Proper lead-in features may be used to tolerate certain degrees of misalignment. After the spline fingers 134 and the spline grooves 136 are fully engaged by applying sufficient over pull from surface, the tool 44 is in the ready-to-disconnect status.

In this example, right-hand torque can be applied from a surface rotary device to break the left-hand thread 128 between a release mandrel 140 of first section 54 and the spline housing 122. Unthreading of the left-hand thread 128 transitions tool 44 to a release stage, thus allowing separation of the first section 54 from the second section 56 via pulling. The left-hand thread 128 does not loosen during initial deployment because the connection is held in place by the shear member 116, e.g. shear screws, and by the right-hand thread of the fastening mechanism 124 coupling the spline sleeve 120 into the second section 56.

Various disconnection selection algorithms may be used for this type of embodiment of on-demand release tool 44. For example, different levels of tensile loading may be associated with activation of specific tools 44. Similarly, different levels of torque may be used for different tools 44 to enable breaking the left-hand thread 128. The different levels of torque may be established by different numbers or specifications of a shear member or shear members located at the fastening mechanism 126/left-hand thread 128.

Figure 20:
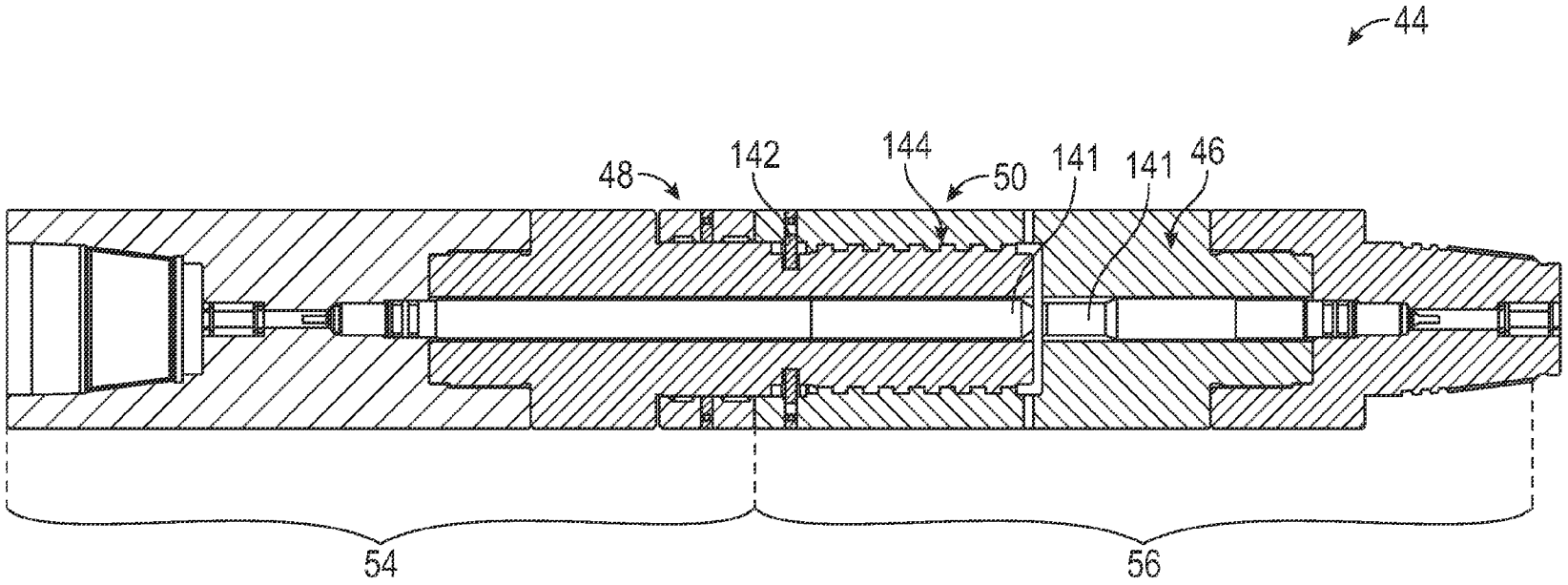
FIG. 20 is a cross-sectional illustration of another example of an activation mechanism and release mechanism combined with a ballistic transfer mechanism, according to an embodiment of the disclosure.

Referring generally to FIG. 20, another embodiment of on-demand release tool 44 is illustrated. In this embodiment, the activation mechanism 48 and the release mechanism 50 are combined in a commercial safety joint style tool 44 and incorporated with a sealed, ballistic transfer mechanism 46 to facilitate use of the sealed ballistic transfer mechanism 46 between sections 42 of gun string 38. The ballistic transfer mechanism 46, which may be similar to embodiments described above, is incorporated into and sealed within the safety joint/tool 44 to facilitate a variety of inter-gun applications. By way of specific example, the ballistic transfer mechanism 46 may employ ballistic transfer components 141 sealed within tool 44 to enable ballistic transfer between the first section 54 and the second section 56 of the on-demand release tool 44.

In this embodiment, the activation mechanism 48 may comprise a shear member 142, such as a plurality of shear screws. The shear member 142 initially locks a threaded release connection 144 which connects the first section 54 and the second section 56 of the on-demand release tool 44. For activation, a torque is applied through the upper string to break the shear member 142. Once activated, the first section 54 and the second section 56 of tool 44 can be unfastened from each other.

According to this embodiment, the selective activation is realized by assigning different thresholds of activation torque for different on-demand release tools 44 positioned along the same gun string 38. The torque threshold can be varied by using shear members 142 having different numbers of shear devices, e.g. shear pins or shear screws, and/or shear devices with different strength ratings.

The release action is executed by rotating the upper string to unfasten the first section 54 from the second section 56 of the tool 44. To avoid accidentally loosening other threaded connections along the overall gun string 38 during the release action, certain options may be employed. For example, the tool 44 may use a left-hand thread at the release connection 144 and a right-hand thread at other threaded connections, or the tool 44 may employ locking tabs at other threaded connections to prevent unfastening. With this latter option, right-hand threads can be used at the release connection 144.

The on-demand release tool or tools 44 may be used in a variety of applications and well string configurations. In some applications, the outside diameter of the tools 44 is selected to match or to be relatively close to that of the gun string 38 so as to limit shock forces due to dynamic under balance. The tools 44 can be constructed to be relatively immune to tension surges and to effects of stabbing in and out of sump packers. Additionally, the tools 44 may be constructed to function on-demand even before firing the guns. In some embodiments, the tools 44 may operate with right-hand release instead of the left-hand release described above. Additionally, the tools 44 may be operated without downhole intervention or with minimal involvement of downhole intervention. Accordingly, the tools 44 have a wide variety of applications in many types of guns strings and other borehole strings.

Furthermore, the configuration and components of the ballistic transfer mechanism, activation mechanism, and/or release mechanism may be adjusted according to the parameters of a given application. For example, various types of collets, splines, spring members, rings, shear members, and/or other components may be constructed and assembled in various forms and arrangements as desired for a given application and a given environment. Similarly, a variety of materials may be used to construct the various components of each on-demand release tool. Additionally, many types of algorithms may be used to provide controlled disconnection and such algorithms may utilize application of torque or rotation; application of tension or overpull; application of annulus or tubing pressure; application of compression or weight; application of reciprocating movement of the well string; use of a ballistic event; and/or other events alone or in combination.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a gun string having a plurality of gun string sections connected by at least one on-demand release tool, the at least one on-demand release tool comprising:

a first section;

a second section releasably coupled with the first section;

a ballistic transfer mechanism;

an activation mechanism employing a release mandrel which holds the first section and the second section in a first loadbearing configuration, the release mandrel being selectively releasable to enable shifting of the first section relative to the second section to a second loadbearing configuration; and a release mechanism comprising an index ring working in cooperation with a ratchet ring, wherein the release mechanism is actuatable through a plurality of actuation inputs to release the first section from the second section to thus enable withdrawal of the first section from the well.

2. The system as recited in claim 1, wherein the plurality of actuation inputs is selected from at least one of applying torque or rotation; applying tension or overpull; applying annulus or tubing pressure; applying compression or weight; applying reciprocating movement of the gun string; and employing a ballistic event.

3. The system as recited in claim 1, wherein the at least one on-demand release tool comprises a plurality of on-demand release tools arranged sequentially along the gun string and separated by gun string sections of the plurality of gun string sections.

4. The system as recited in claim 1, wherein the release mandrel of the activation mechanism comprises a collet initially engaging the second section and held in engagement with the second section by a pressure actuated support piston.

5. The system as recited in claim 4, wherein the pressure actuated support piston is shifted by a pressure increase resulting from firing of at least one of the gun string sections.

6. The system as recited in claim 4, wherein the pressure actuated support piston is shifted by a pressure increase resulting from an annulus pressure increase and a bursting of a rupture disc.

7. The system as recited in claim 1, wherein the release mandrel uses a shear member to initially hold the second section in the first loadbearing configuration.

8. The system as recited in claim 1, wherein the index ring is selectively ratcheted relative to the second section via a ratchet mechanism, the ratchet mechanism being shifted via the plurality of actuation inputs until the first section is released from the second section.

9. The system as recited in claim 1, wherein the release mechanism comprises a selectively engageable spline sleeve and a left-hand thread.

10. The system as recited in claim 1, wherein the activation mechanism and the release mechanism are combined in a safety joint, the safety joint comprising an internally sealed ballistic transfer mechanism to facilitate usage of the ballistic transfer mechanism between gun string sections of the plurality of gun string sections.

11. A system, comprising:

an on-demand release tool having an activation mechanism and a release mechanism which may be selectively actuated to transition the on-demand release tool from a first loadbearing configuration to a second loadbearing configuration and subsequently to a release stage in which a first section of the on-demand release tool may be separated from a second section of the on-demand release tool by a plurality of actuation inputs, wherein the release mechanism comprises an index ring working in cooperation with a ratchet ring.

12. The system as recited in claim 11, further comprising a plurality of gun string sections coupled to the on-demand release tool.

13. The system as recited in claim 11, wherein the activation mechanism employs a release mandrel having a collet initially holding the first section and the second section in the first loadbearing configuration.

14. The system as recited in claim 11, wherein the activation mechanism employs a release mandrel having a shear member initially holding the first section and the second section in the first loadbearing configuration.

15. The system as recited in claim 11, wherein the release mechanism is shifted to the release stage via unthreading a left-hand thread.

16. The system as recited in claim 11 , wherein the index ring is selectively ratcheted relative to the second section via a ratchet mechanism, the ratchet mechanism being shifted via the plurality of actuation inputs until the first section is released from the second section.

17. A method for selectively releasing a portion of a well string, comprising:

coupling a plurality of well string sections with an on-demand release tool having a first section and a second section;

using an activation mechanism of the on-demand release tool to couple the first section and the second section at a first loadbearing configuration;

providing a release mechanism to couple the first section and the second section at a second loadbearing configuration after actuation of the activation mechanism, the release mechanism comprising an index ring working in cooperation with a ratchet ring; and selectively actuating the release mechanism via a predetermined plurality of actuation inputs to shift the on-demand release tool to a release stage allowing separation of the first section from the second section.

18. The method as recited in claim 17, wherein coupling comprises coupling a plurality of gun string sections with a plurality of the on-demand release tools; and further comprising providing the plurality of on-demand release tools with a passive disconnect selection algorithm to enable selective release and separation of specific on-demand release tools.

19. The method as recited in claim 17, further comprising utilizing an algorithm to differentiate at least one of a predetermined shear load and a predetermined number of cycles employed for separation of a specific on-demand release tool among a plurality of individual on-demand release tools deployed in a gun string.

* * * * *